US007334274B2

(12) United States Patent
Wang

(10) Patent No.: US 7,334,274 B2
(45) Date of Patent: Feb. 26, 2008

(54) SWIRLING BATHING TUB

(76) Inventor: Cheng-Chung Wang, 12F, No. 440, Sec. 4, Jen-Ai Rd., Taipei (TW)

( * ) Notice: Subject to any disclaimer, the term of this patent is extended or adjusted under 35 U.S.C. 154(b) by 270 days.

(21) Appl. No.: 10/920,304

(22) Filed: Aug. 18, 2004

(65) Prior Publication Data

US 2005/0055762 A1 Mar. 17, 2005

(30) Foreign Application Priority Data

Sep. 17, 2003 (CN) ..... 03 2 74587

(51) Int. Cl.
*A61H 33/02* (2006.01)

(52) U.S. Cl. ..... 4/541.4; 4/541.3; 4/541.6

(58) Field of Classification Search ..... 4/541.1, 4/541.3, 541.4, 541.6, 492
See application file for complete search history.

(56) References Cited

U.S. PATENT DOCUMENTS 3,476,106 A * 11/1969 Brazel et al. ..... 4/492 X
3,571,818 A * 3/1971 Jacuzzi ..... 4/541.4
4,000,528 A * 1/1977 Posnick ..... 4/541.1 X
5,197,153 A * 3/1993 Hara ..... 4/541.4
5,862,543 A * 1/1999 Reynoso et al. ..... 4/541.6
5,915,849 A * 6/1999 Dongo ..... 4/541.6
6,406,446 B1 * 6/2002 Takagi et al. ..... 4/541.4 X
6,412,123 B1 * 7/2002 Lau ..... 4/541.1

* cited by examiner

*Primary Examiner*—Robert M. Fetsuga
(74) *Attorney, Agent, or Firm*—Bacon & Thomas, PLLC

(57) ABSTRACT

A swirling bathing tub includes a bathing tub, a water ejecting device mounted on an inner side face of the bathing tub and having at least one water outlet defined in the casing and a water inlet for connection with a water source, a water pump mounted inside the casing and having a water inflow pipe in communication with the water inlet and a water outflow pipe corresponding to the at least one water outlet, a baffle rotatably mounted inside the casing and having at least one through hole corresponding to the at least one water outlet so that water flowing through the water outflow pipe of the pump is able to selectively flow to the bathing tub to create a soothing massaging effect to the user.

14 Claims, 7 Drawing Sheets

SWIRLING BATHING TUB

BACKGROUND OF THE INVENTION

1. Field of the Invention

The present invention relates to a swirling bathing tub, and more particularly to a swirling bathing tub having water jets selectively ejecting outward to accommodate the number of users inside the bathing tub.

2. Description of Related Art

Jacuzzis™ have been popular for decades for the relaxation and the sensation they bring to the users. Recently, a water ejecting device has been fitted to the Jacuzzi so that the user not only is able to enjoy the fun of bathing, also the user is able to have the therapeutic effect caused by the water jets. Whatever the effect and enjoyment the Jacuzzi can bring to the users, they remain expensive and bulky such that they are not practical for many homes. To overcome the shortcomings, the present invention tends to provide an improved swirling bathing tub to mitigate the aforementioned problems.

SUMMARY OF THE INVENTION

The primary objective of the present invention is to provide an improved swirling bathing tub which is inexpensive and simple in structure.

Another objective of the present invention is that the swirling bathing tub has a baffle rotatably mounted on the water ejecting device and provided with multiple through holes selectively in alignment with water outlets of the water ejecting device so that the user is able to adjust the number of water jets depending on the number of users in the bathing tub to thus have the maximum enjoyment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
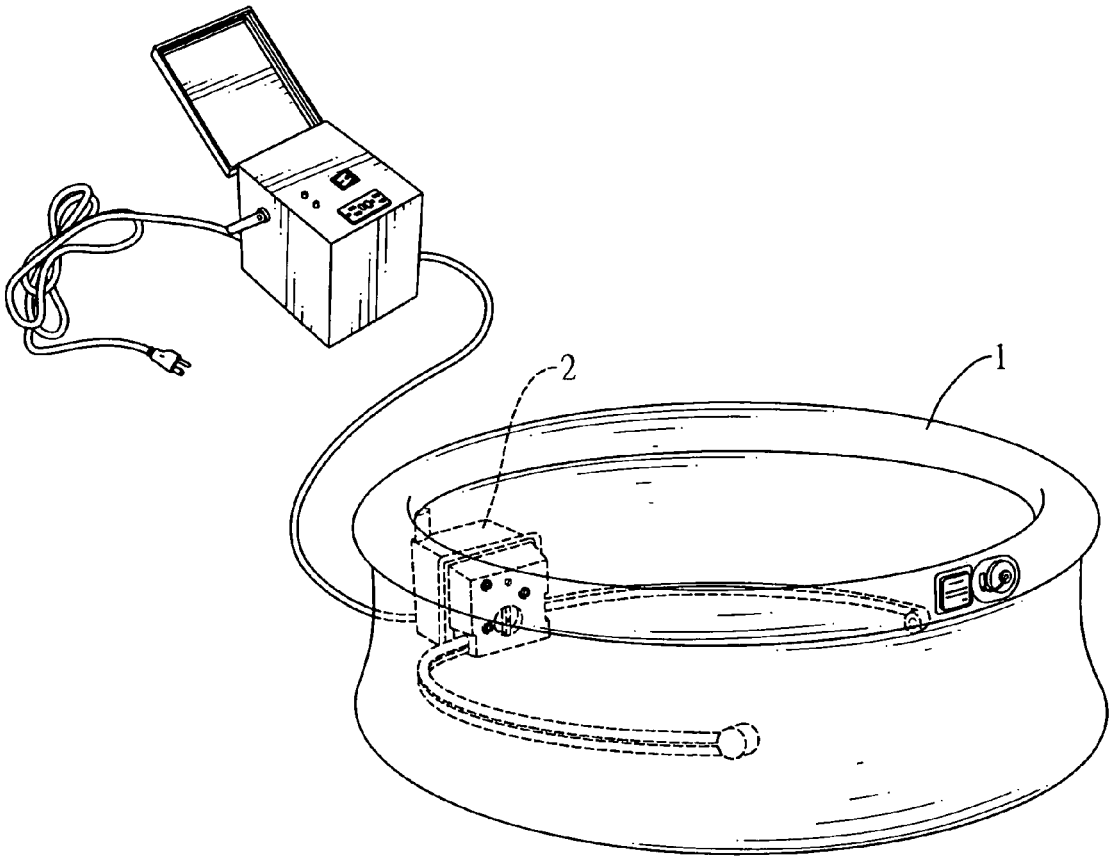
FIG. 1 is perspective view showing the swirling bathing tub of the present invention.

With reference to FIG. 1, the swirling bathing tub in accordance with the present invention includes a tub (1) preferably made of a resilient material and a water ejecting device (2) mounted on an inner side face of the resilient material of the tub (1).

Figure 2:
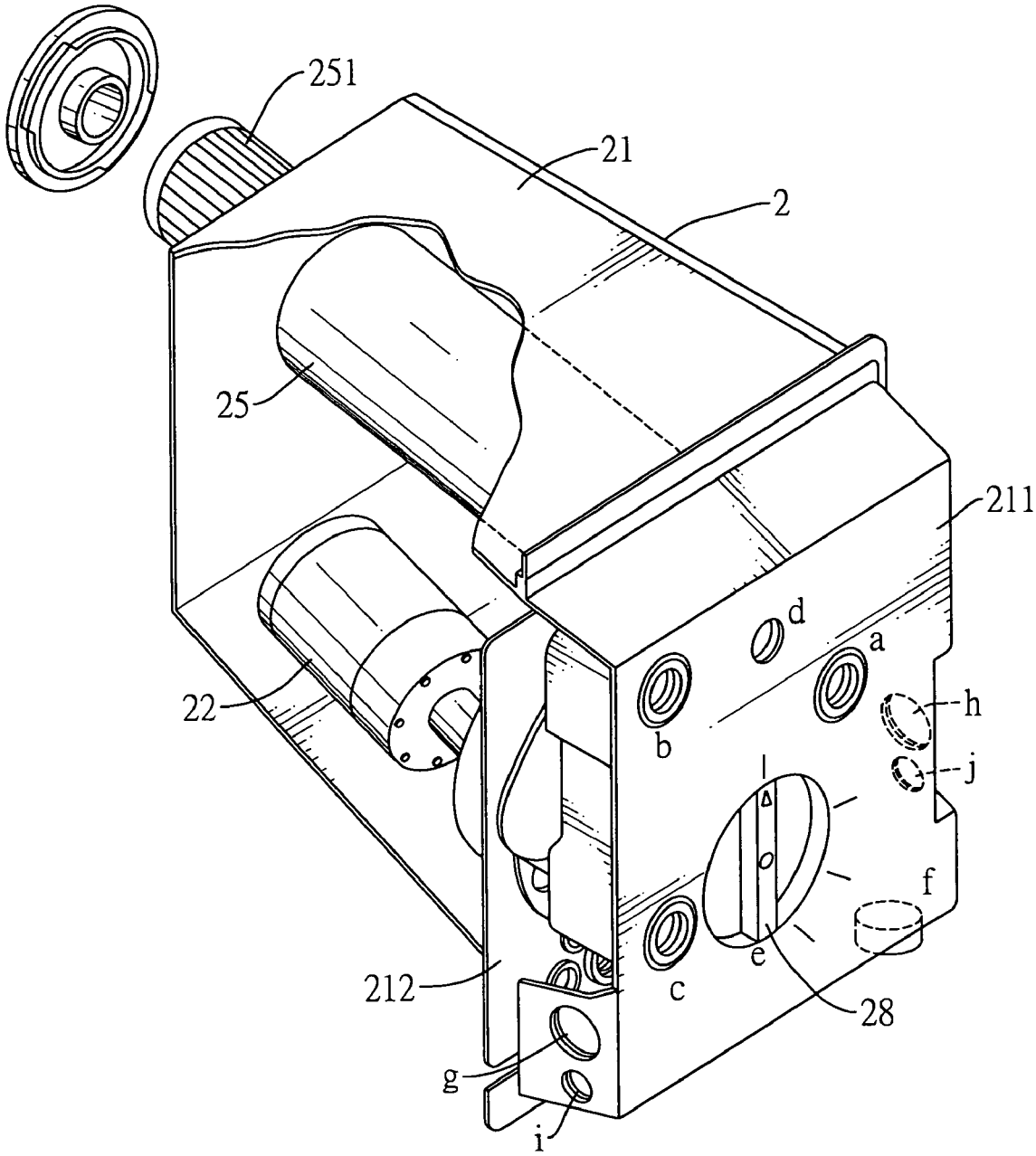
FIG. 2 is a perspective view of the water ejecting device of the present invention, wherein a portion of the water ejecting device is broken away for clarity.
Figure 3:
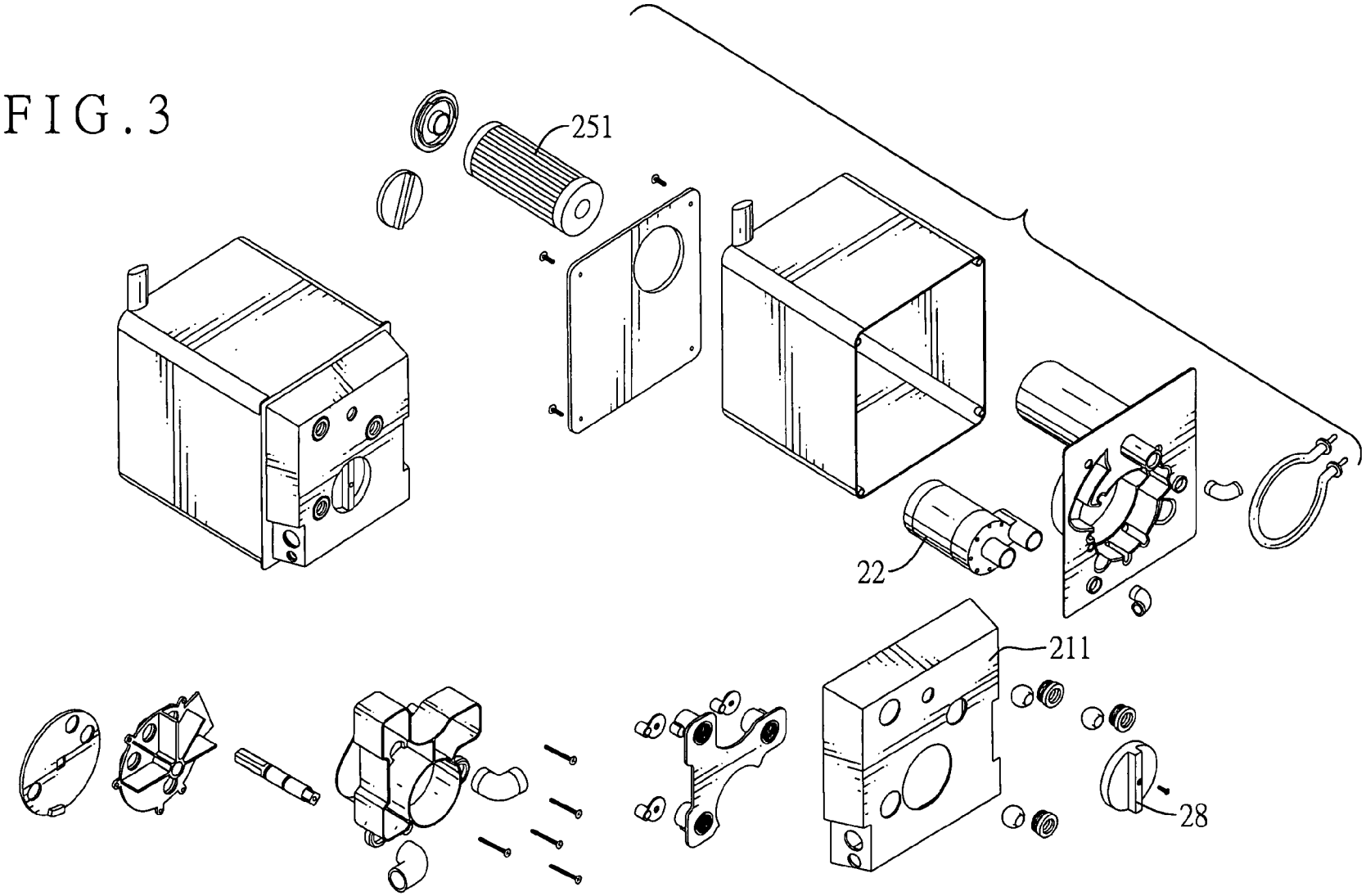
FIG. 3 is an exploded perspective view of the water ejecting device in FIG. 2.
Figure 4:
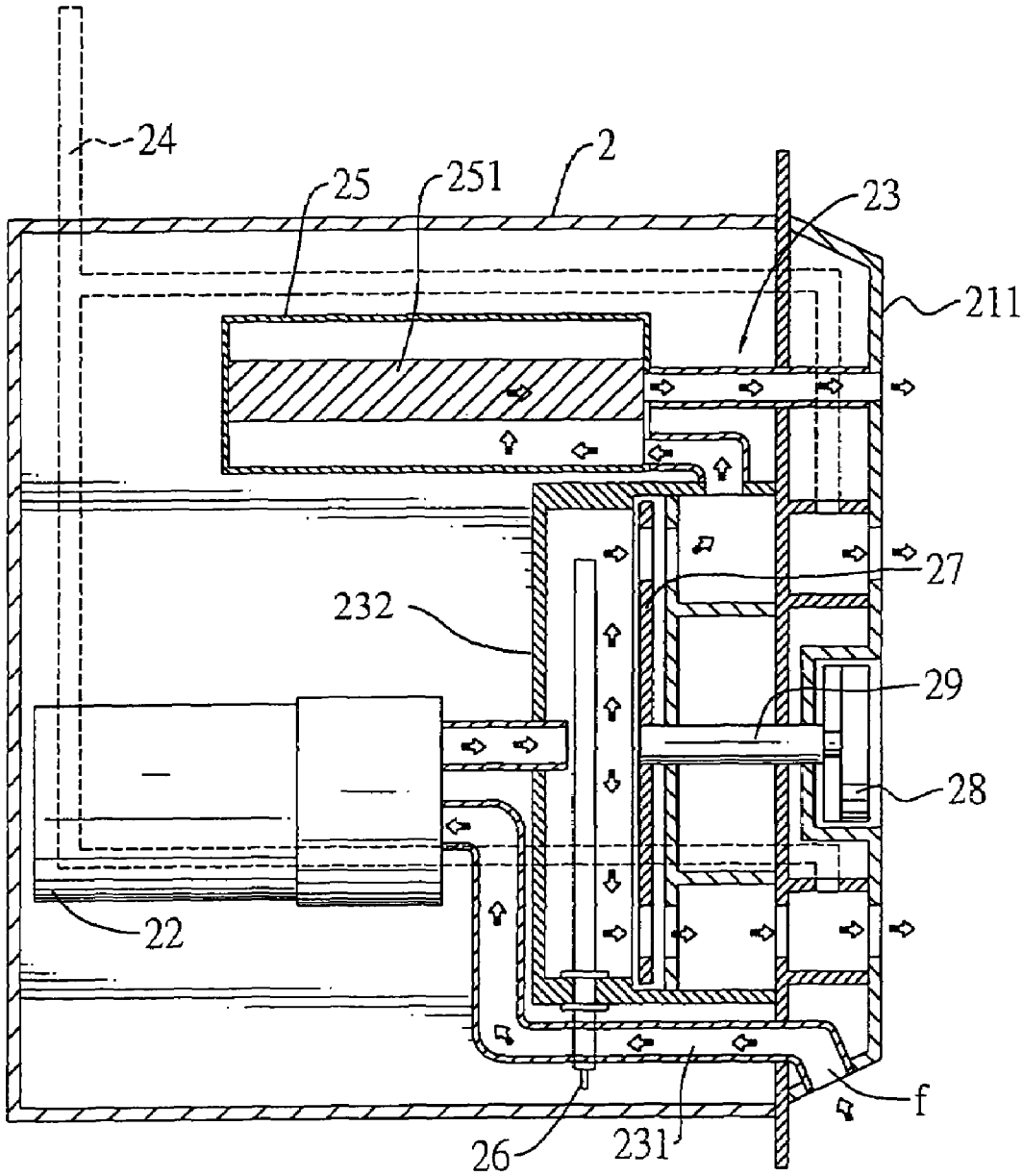
FIG. 4 is a schematic cross sectional view showing the water flowing pattern inside the water ejecting device of the present invention.
Figure 5:
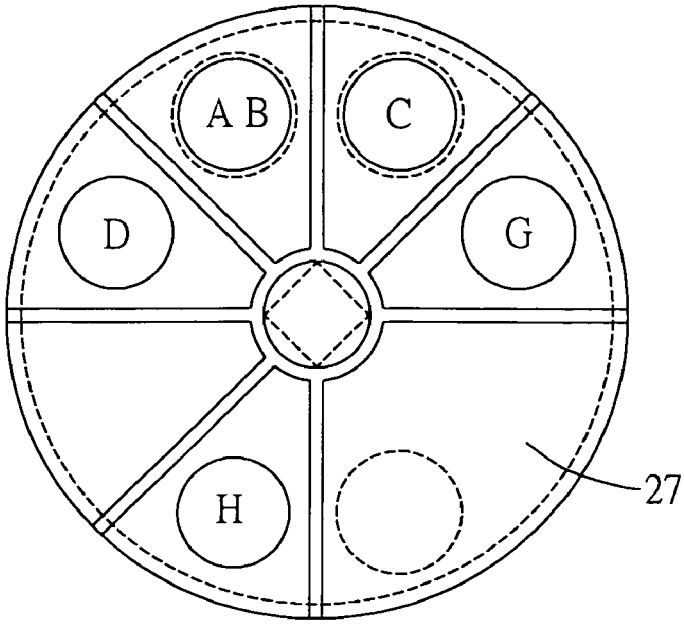
FIGS. 5 to 8 are schematic views showing the alignment between different water outlets and the through holes of the baffle.
Figure 6:
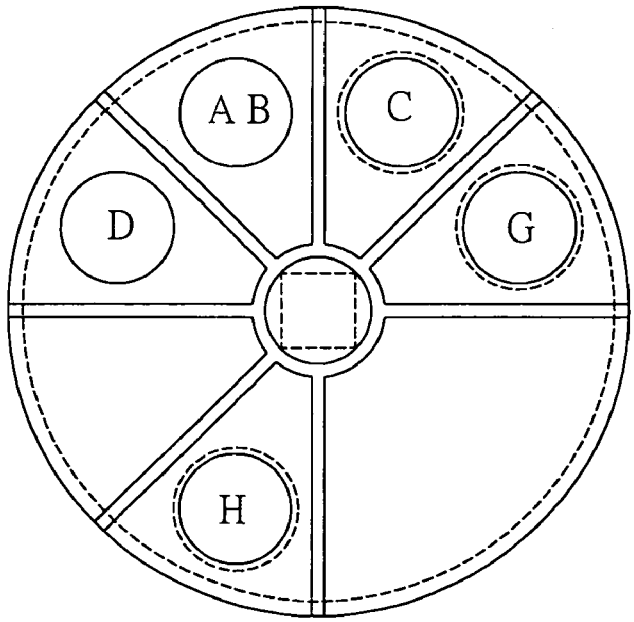
Figure 7:
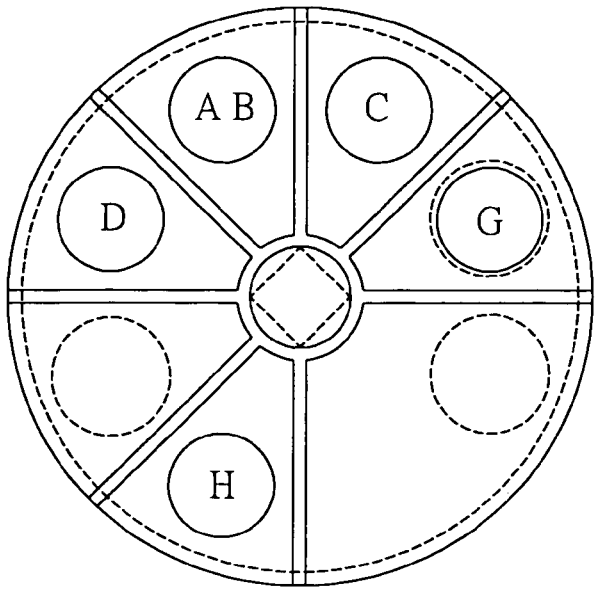
Figure 8:
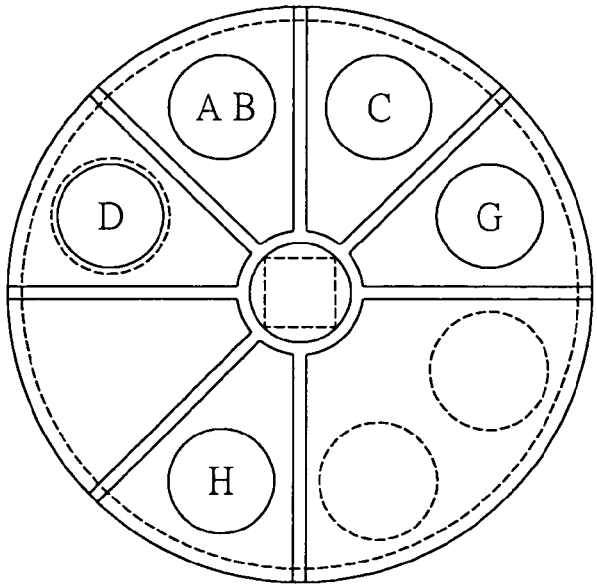

With reference to FIGS. 2 to 4, the water ejecting device (2) has a casing (21), a water pump (22) inside the casing (21), water pipes (23), an air inlet (24), a filter housing (25), a filter (251) inside the filter housing (25) (shown inside the casing (21) in an illustrated embodiment), a heater (26) and a movably mounted baffle (27).

The casing (21) is mounted inside the tube (1) and has six water outlets (a,b,c,d,g,h) and a water inlet (f). The water outlets (a,b,c) are formed through a front face (211) of the casing (21). The water outlets (g,h) are respectively formed through two side faces (212) and the water inlet (f) is defined in a bottom side face beneath the side face (211) to ensure that the water inlet (f) is always under the water surface inside the tub (1).

The filter (251) has an inlet in communication with a water outflow pipe (232) of the water pump (22) and an outlet in communication with the casing outlet (d).

The water pump (22) is mounted inside the casing (21) and has a water inflow pipe (231) in communication with the water inlet (f) of the casing (21). A water heater (26) is mounted inside the water outflow pipe (232) such that water is able to be heated before the water flows to the tub (1). A knob (28) is rotatably mounted on the casing (21) and connected to the baffle (27) via a linkage (29). Therefore, the baffle (27) is rotatable with respect to the casing (21). The air inlet (24) of an illustrated embodiment is provided inside the casing (21) and is in communication with surrounding air and the water outlets (a,b,c,d,g,h) so that bubbles are created inside the water flow to the tub (1) to provide a soothing massage effect. Air outlets (i,j) are provided close to the water outlets (g,h).

The baffle (27) has multiple through holes (not numbered) corresponding to the water outlets (a,b,c,d,g,h). However, because the baffle (27) is rotatable relative to the casing (21), the rotation of the knob (28) drives the baffle (27) to rotate accordingly such that some of the through holes of the baffle (27) may not communicate with all the water outlets (a,b, c,d,g,h).

Furthermore, the further reference to FIGS. 1 and 2, two extending tubes (40) respectively connect to the water outlets (g,h) in the side faces (212) of the casing (21). Each extending tube (40) has a proximal end and a free end. The proximal end connects to and communicates to the corresponding water outlet (g,h). The free end extends into the bathing tub (1) to allow water flowing through the extending tube (40) into the bathing tub (1). With the extending tubes (40), multiple users can sit more spaced out in the bathing tub (1).

With reference to FIGS. 4-8, the knob (28) has four different positions to control water to flow to the required water outlets (a,b,c,d,g,h). When the knob (28) is at the first position, water flows to the water outlets (a,b,c) so that water flows out from the front face (211) of the casing (21) and a single user sitting in front of the casing (21) is able to have better massaging area. When the knob (28) is at the second position, water flows to the water outlets (c,g,h) so that water flows out from the front and side faces (211. 212) of the casing (21) and three users sitting in front of the casing (21) and in front of the free ends of the extending tubes (40) may enjoy the tub (1) simultaneously. When the knob (28) is at the third position, water flows to the water outlet (g) so that water flows out from one side face (212) of the casing (21) and a single user is able to have the maximum massaging strength from the water flowing out of the water outlet (h). When the knob (28) is at the fourth position, water flows out only from the water outlet (d) so that water flow is directed through the filter housing and contaminant in the water can be entirely filtered.

Figure 9:
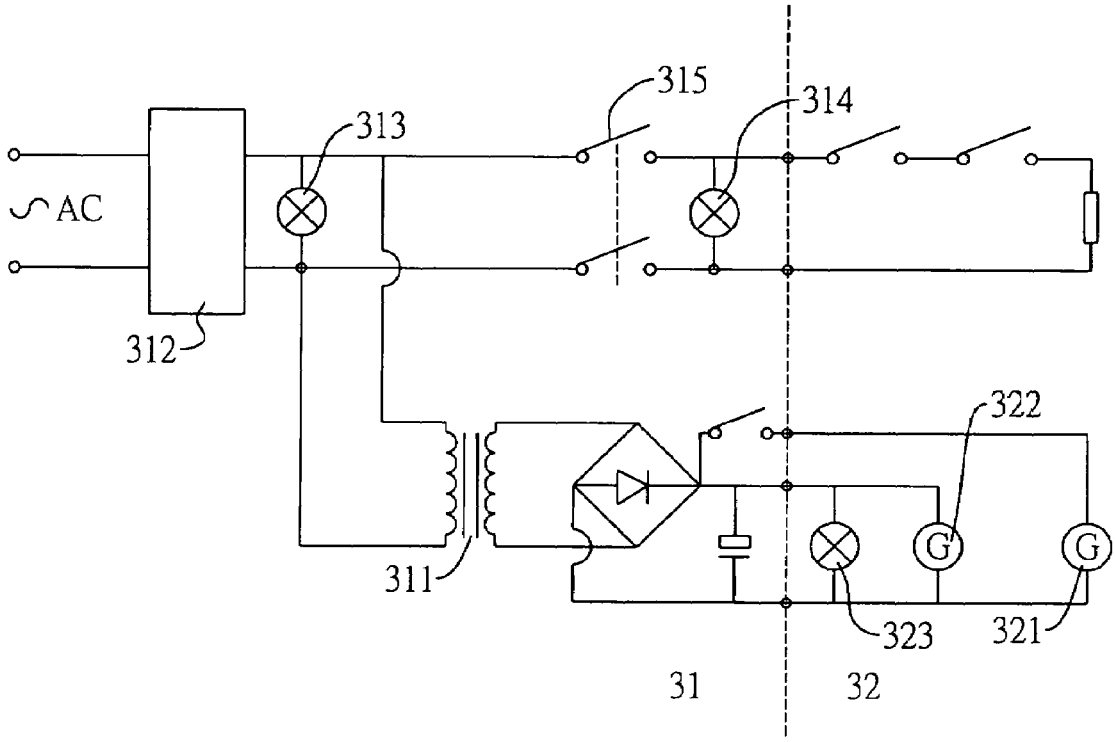
FIG. 9 is a schematic circuit used in the water ejecting device of the present invention.

With reference to FIG. 9, the circuit of the water ejecting device (2) of the present invention is shown and has a junction box portion (31), an immersed portion (32), a transformer (311), a safety switch (312), a power indicator (313), a heating indicator (314), a heating switch (315), a PACK motor (321), a pump motor (322) and an indication lamp (323). Because the circuit of the water ejecting device (2) is well known in the art, detailed description concerning the features and function of the device is thus omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A swirling bathing tub comprising:

a bathing tube made of a resilient material;

a water ejecting device having a casing mounted inside the bathing tub and having multiple water outlets and a water inlet for connection with a water source, a baffle movably mounted inside the casing, a water pump mounted inside the casing and having a water inflow opening in communication with the water inlet of the casing and a water outflow opening corresponding to the at least one water outlet of the casing, so that water flowing through the water outflow pipe of the pump is able to flow out of the at least one water outlet to the bathing tub;

at least one extending tube having a proximal end connecting and communicating to a corresponding water outlet of the casing and a free end such that water can flow through the extending tube into the bathing tub;

wherein the baffle has multiple through holes selectively corresponding to and communicating with the water outlets in the casing to selectively allow water to flow through at least one of the water outlets and to flow out from at least one of the extending tubes.

2. The swirling bathing tub as claimed in claim 1, wherein a knob is rotatably mounted on the casing to control the rotation of the baffle.

3. The swirling bathing tub as claimed in claim 2, wherein a linkage is provided to connect the knob to the baffle so that rotation of the knob is able to drive the baffle to rotate accordingly.

4. The swirling bathing tub as claimed in claim 3 further comprising a filter inside the casing to filter the water flowing inside the casing from the water inlet.

5. The swirling bathing tub as claimed in claim 4 further comprising a water heater mounted in the to heat the water flowing out of the water pump.

6. The swirling bathing tub as claimed in claim 5, wherein an air inlet is provided inside the casing and in communication with surrounding air and the at least one water outlet such that when water is flowing to the bathing tub, the air from the air inlet mixes with the water to create a massage effect.

7. The swirling bathing tub as claimed in claim 4, wherein an air inlet is provided inside the casing and in communication with surrounding air and the at least one water outlet such that when water is flowing to the bathing tub, the air from the air inlet mixes with the water to create a massaging effect.

8. The swirling bathing tub as claimed in claim 3 further comprising a water heater mounted in the casing to heat the water flowing out of the water pump.

9. The swirling bathing tub as claimed in claim 8, wherein an air inlet is provided inside the casing and in communication with surrounding air and the at least one water outlet such that when water is flowing to the bathing tub, the air from the air inlet mixes with the water to create a massaging effect.

10. The swirling bathing tub as claimed in claim 3, wherein an air inlet is provided inside the casing and in communication with surrounding air and the at least one water outlet such that when water is flowing to the bathing tub, the air from the air inlet mixes with the water to create a massaging effect.

11. The swirling bathing tub as claimed in claim 1 further comprising a filter inside the casing to filter the water flowing inside the casing from the water inlet.

12. The swirling bathing tub as claimed in claim 1 further comprising a water heater provided in the casing to heat the water flowing out of the water pump.

13. The swirling bathing tub as claimed in claim 1, wherein an air inlet is provided inside the casing and in communication with surrounding air and the at least one water outlet such that when water is flowing to the bathing tub, the air from the air inlet mixes with the water to create a massaging effect.

14. The swirling bathing tub as claimed in claim 1, wherein the casing has a front face and two side faces;

the water outlets of the casing respectively formed through the front and side faces of the casing; and the baffle selectively allows water flowing through at least one of the water outlets in the front face and in the side faces of the casing.

* * * * *